US006301902B1

(12) United States Patent
Zhu et al.

(10) Patent No.: US 6,301,902 B1
(45) Date of Patent: Oct. 16, 2001

(54) PULSE TUBE REFRIGERATOR

(75) Inventors: Shaowei Zhu; Shin Kawano, both of Kariya; Masafumi Nogawa, Toyota; Tatsuo Inoue, Anjo, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/539,324

(22) Filed: Mar. 30, 2000

(30) Foreign Application Priority Data

Mar. 30, 1999 (JP) ..... 11-090047

(51) Int. Cl.[7] ..... F25B 9/00
(52) U.S. Cl. ..... 62/6
(58) Field of Search ..... 62/6

(56) References Cited

U.S. PATENT DOCUMENTS 5,412,952 * 5/1995 Ohtani et al. ..... 62/6
5,481,878 * 1/1996 Shaowei ..... 62/6
5,711,156 * 1/1998 Matsui et al. ..... 62/6
5,845,498 * 12/1998 Matsui et al. ..... 62/6
6,082,117 * 7/2000 Funatsu et al. ..... 62/6
6,094,921 * 8/2000 Zhu et al. ..... 62/6

* cited by examiner

*Primary Examiner*—William Doerrler
*Assistant Examiner*—Malik N. Drake
(74) *Attorney, Agent, or Firm*—Oblon, Spivak, McClelland, Maier & Neustadt, P.C.

(57) ABSTRACT

A pulse tube refrigerator includes a compressor, a first high pressure valve connected with the compressor, a first high pressure passage connecting the outlet port of the compressor with the first high pressure valve, a first low pressure valve connected with the compressor, first low pressure passage connecting the inlet port of the compressor with the first low pressure valve, a regenerator connected with the first high pressure valve and the first low pressure valve, a cold head connected with the regenerator, a pulse tube connected with the cold head a second high pressure valve connected with the pulse tube. The pulse tube refrigerator further includes a second low pressure valve connected with the pulse tube, a high pressure cylinder provided in the second high pressure passage, a high pressure side partition element reciprocally provided within the high pressure cylinder and fluid tightly dividing the high pressure side cylinder into a first high pressure space and a second high pressure space, a low pressure cylinder provided in the second low pressure passage; and a low pressure side partition element reciprocally provided within the low pressure side cylinder and fluid tightly dividing the low pressure cylinder into a first low pressure space and a second low pressure space.

11 Claims, 9 Drawing Sheets

PULSE TUBE REFRIGERATOR

BACKGROUND OF THE INVENTION

1. Field of the Invention

This invention relates to a pulse tube refrigerator, and more particularly to a structure of a four valve type pulse tube refrigerator.

2. Discussion of the Background

A conventional four valve type pulse tube refrigerator is shown in FIG. 11. In the drawing, a four valve type pulse tube refrigerator 201 includes a compressor 1, a first high pressure on-off valve 4 connected with an outlet port 1*a* through a first level high pressure passage 2, a first low pressure on-off valve 5 connected with an inlet port 1*b* through a first level low pressure passage 3, a regenerator 8 having a low temperature end 8*a* and a high temperature end 8*b*, the regenerator being connected with the first high pressure on-off valve 4 through a regenerator side high pressure passage 6 at the high temperature end 8*b* of the regenerator 8 and being connected with the first low pressure on-off valve 5 through a regenerator side low pressure passage 7, cold head 9 connected with the low temperature end 8*a* of the regenerator 8, a pulse tube 10 having a low temperature end 10*a* and high temperature end 10*b* and connected with the cold head 9 at the low temperature end 10*b* thereof, a second high pressure on-off valve 11 connected with a radiator 15 attached to the high temperature end 10*b* through a pulse tube side high pressure passage 16, a second low pressure on-off valve 12 connected with the radiator 15 through a pulse tube side low pressure passage 17, a second level high pressure passage 13 connected with the first level high pressure passage 2 at one end and connected with the second high pressure on-off valve 11 at the other end, and a second level low pressure passage 14 connected with the first level low pressure passage 3 at one end and connected with the second low pressure on-off valve 12 at the other end. The space defined by the four valves (first high pressure on-off valve 4, second high pressure on-off valve 11, first low pressure on-off valve 5 and second low pressure on-off valve 12) and the compressor 1 operates as a working space (or an operating space) of the pulse tube refrigerator 201.

FIG. 12 illustrates valve on-off operations of the first high pressure on-off valve 4, the second high pressure on-off valve 11, the first low pressure on-off pressure valve 5 and the second low pressure on-off valve 12 in accordance with the operation of the pulse tube refrigerator 201 of FIG. 11. In the drawing, bold lines show the valve-on conditions and fine lines show the valve-off conditions of the valves. As shown in FIG. 12, the four valves, i.e., first high pressure on-off valve 4, second high pressure on-off valve 11, first low pressure on-off valve 5, and second low pressure on-off valve 12 are turned on in sequence. By sequentially turning on the four valves, the phase between the pressure changes of the operational gas, and movements (displacements) thereof, is controlled to generate a refrigeration output within the pulse tube 10 and extract a low temperature at the cold head 9. (see FIG. 11)

The above explained conventional four valve type pulse tube refrigerator and other conventional four valve type refrigerators have basic problems which cannot be solved, due to their operating principle. The problems are the low refrigeration efficiency and the lack of operating stability. The main cause of the low refrigeration efficiency is the operational loss caused by the returning of the operational gas from the operating space into the compressor. That is, a portion of the operational gas which has entered the operating space from the compressor 1 through the second high pressure on-off valve 4 during the operation of pulse tube refrigerator returns to the compressor 1 again from the second level low pressure passage 14 through the second low pressure on-off valve 12. The compressor 1 therefore has to work extra due to the unnecessary flow of the returning gas thereinto. This extra work of the compressor causes a low efficiency of the refrigerator.

The main cause of the lack of stability is the generation of a one way flow gas whose amount exceeds a fixed amount defined by the cycle within the pulse tube 10 due to the operational gas flow (in and out) from the compressor 1 in both directions from regenerator 8 side and pulse tube 10 side. (This one way flow gas may be defined as a circulation flow gas if the flow passages are included.)

The one way or circulation flow gas runs from the compressor 1 into the operating space through the first level high pressure passage 2 and the first high pressure on-off valve 4 and returns to the compressor 1 through the second low pressure on-off valve 12 and the second level low pressure passage 14. In another flow route, the operating gas runs from the compressor 1 into the operating space through the second level high pressure passage 13 and the second high pressure on-off valve 11 and returns to the compressor 1 through the first low pressure on-off valve 5 and the first level low pressure passage 3. Such a flow route may be variable depending on the operational conditions of the refrigerator 201. The above extra one way or circulation flow causes instability of the operation of the refrigerator.

SUMMARY OF THE INVENTION

It is therefore an object of the present invention to overcome the above drawbacks of the conventional refrigerator.

It is another object of the present invention to improve the efficiency of the refrigeration.

It is a further object of the present invention to improve the stability of the refrigerator under operation by avoiding the generation of the one way flow of the operating gas.

In order to solve the above and other technical problems, the pulse tube refrigerator according to this invention includes a compressor, a first high pressure on-off valve connected with an outlet port of the compressor through a first level high pressure passage, a first low pressure on-off valve connected with an inlet port of the compressor through a first level low pressure passage, a regenerator having a low temperature end and a high temperature end, the regenerator being connected with the first high pressure on-off valve and the first low pressure on-off valve at the high temperature end of the regenerator, a cold head connected with the low temperature end of the regenerator, a pulse tube having a low temperature end and a high temperature end and connected with the cold head at the low temperature end thereof, a second high pressure on-off valve connected with the high temperature end of the pulse tube, a second low pressure on-off valve connected with the high temperature end of the pulse tube, a second level high pressure passage connected with the first level high pressure passage at one end and connected with the second high pressure on-off valve at the other end, a second level low pressure passage connected with the first level low pressure passage at one end and connected with the second low pressure on-off valve at the other end, a high pressure side cylinder provided in the second level high pressure passage, a high pressure side partition element reciprocally provided within the high pressure side cylinder and fluid tightly dividing the high pressure side cylinder into a first high pressure space connected with the first level high pressure passage and a second high pressure space connected with the second high pressure on-off valve, a low pressure side cylinder provided in the second level low pressure passage and a low pressure side partition element reciprocally provided within the low pressure side cylinder and fluid tightly dividing the low pressure side cylinder into a first low pressure space connected with the first level low pressure passage and a second low pressure space connected with the second low pressure on-off valve within the low pressure side cylinder.

According to the feature of the invention, since the high pressure side cylinder is provided in the second level high pressure passage and the space in this high pressure side cylinder is fluid tightly divided by the high pressure side partition element into the first high pressure space connected with the first level high pressure passage and the second high pressure space connected with the second high pressure on-off valve, and further since the low pressure side cylinder is provided in the second level low pressure passage and the space in the low pressure side cylinder is fluid tightly divided by the low pressure side partition element into the first low pressure space connected with the first level low pressure passage and the second low pressure space connected with the second low pressure on-off valve, the one way fluid flow from the operating space to the compressor through the second low pressure on-off valve and the second level low pressure passage is interrupted by the low temperature side partition element provided in the low pressure side cylinder which is disposed in the second level low pressure passage.

Accordingly the instability of the operation can be obviated by avoiding the undesired one way flow of the operating gas. Further, the operating gas flow into the operating space from the second level high pressure passage cannot return to the compressor through the second level low pressure on-off valve and second level low pressure passage by the provision of the low pressure side partition element in the second level low pressure passage. This leads to efficient use of the operating gas in the operating space during operation of the refrigerator, and accordingly high efficiency refrigeration can be carried out.

It is preferable to provide a pulse tube refrigerator with an intermediate pressure unit which includes an intermediate pressure passage connected with the high temperature side of the pulse tube at one end, an intermediate pressure on-off valve disposed in the intermediate pressure passage, and an intermediate pressure buffer tank connected with the other end of the intermediate pressure passage. According to the above preferable feature of the invention, it is possible to provide an intermediate pressure operating condition in the refrigerator between the high pressure operating condition and the low pressure condition, or vice versa, by on-off operation of the intermediate pressure on-off valve.

This structure may decrease the pressure difference generated when the pressure changes in the operating space from the high pressure condition to intermediate pressure condition, and low pressure condition, or vice versa. The pressure change in the operating space of the above described conventional refrigerator is operated only from the high pressure to the low pressure conditions or from the low pressure to the high pressure conditions without having the intermediate pressure stage. This may cause an increase of the pressure difference due to the sudden pressure change from high to low, or vice versa. According to the feature of the invention, the operating loss at the high pressure on-off valves and low pressure on-off valves, which becomes larger in proportion to the amount of the pressure difference, can be decreased to improve the operating efficiency of the refrigerator.

It is another preferable feature of the invention is to provide a plurality of the intermediate pressure units in the refrigerator. It is thus possible to control the pressure changes in the operating space more finely and efficiently during the valve on-off operations, thereby to reduce the operating loss at the valves.

It is another feature of the invention to provide an improved pulse tube refrigerator which comprises an intermediate pressure unit having an intermediate pressure passage connected with the pulse tube at the high temperature side thereof, an orifice provided in the intermediate pressure passage, and an intermediate pressure buffer tank connected with the other end of the intermediate pressure passage. According to this feature of the invention, by connecting the intermediate pressure buffer tank with the high temperature side of the pulse tube through the orifice, one can generate a high power output using a pulse tube refrigerator of a low pressure rate type.

According to still another feature of the invention, a by-pass passage connects the high temperature side of the regenerator with the high temperature side of the pulse tube, and an orifice is formed in the by-pass passage. This type of refrigerator can control the range of the operating gas movement in the operating space by connecting the high temperature side of the regenerator with the high temperature side of the pulse tube. This feature of the invention can be used particularly in a cryogenic refrigerator.

BRIEF DESCRIPTION OF THE DRAWINGS

These and other objects and features of the invention will be more apparent and more readily appreciated from the following detailed description of the preferred embodiments of the invention with the accompanying drawings, in which.

DESCRIPTION OF THE PREFERRED EMBODIMENTS

Figure 1:
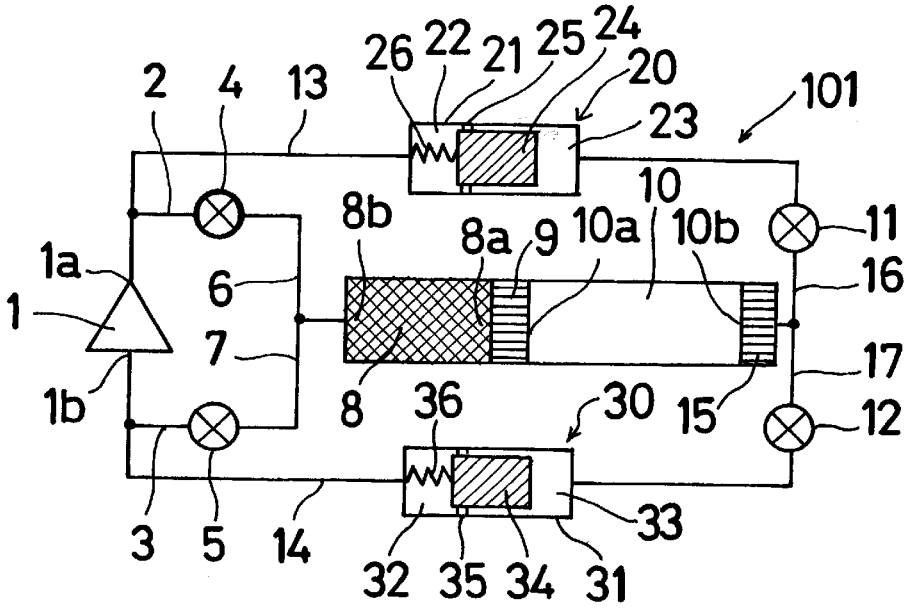
FIG. 1 shows a structural concept of a pulse tube refrigerator of a first embodiment of the present invention.
Figure 11:
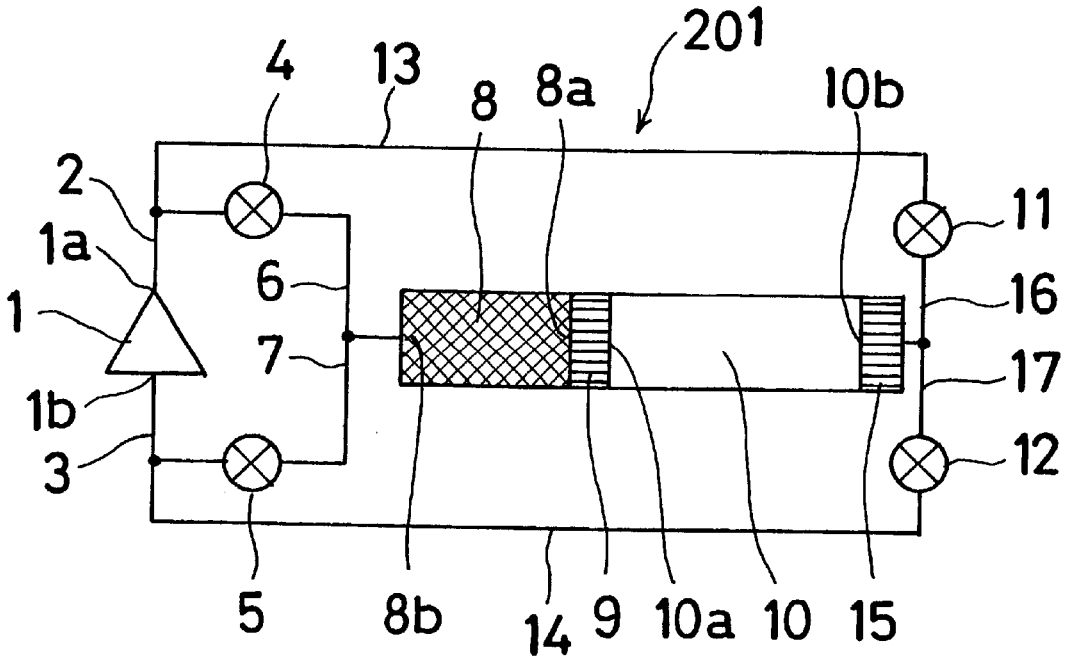
FIG. 11 shows a structural concept of a conventional pulse tube refrigerator.
Figure 12:
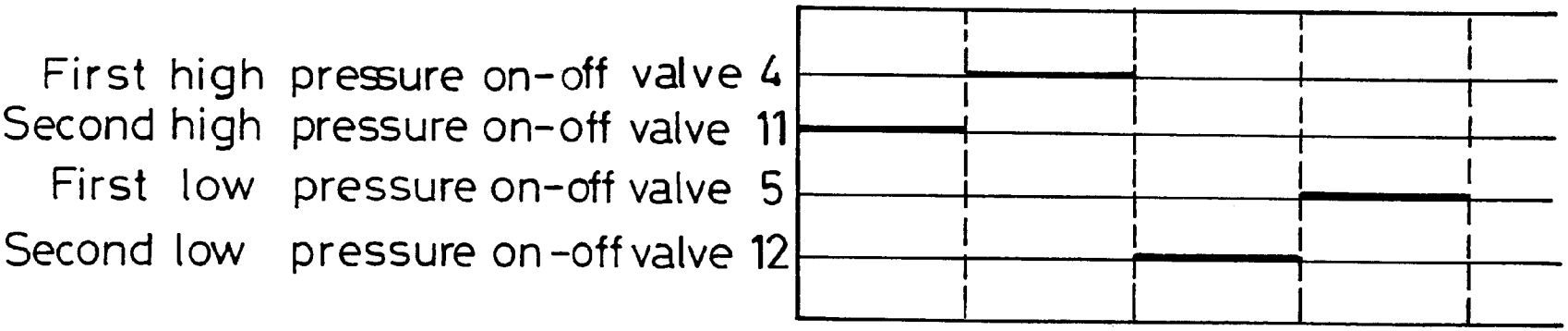
FIG. 12 is a graph illustrating on-off conditions of a first high pressure on-off valve, a second high pressure on-off valve, a first low pressure on-off valve, and a second low pressure on-off valve under the pulse tube refrigerator operation with a pressure change condition in the operating space of the conventional pulse tube refrigerator in FIG. 11.

Referring now to the embodiments of the present invention with reference to the attached drawings in which same reference numerals used in the conventional refrigerator already explained in FIG. 11 and FIG. 12, wherein:

FIG. 1 shows the first embodiment of the invention. In the drawing, pulse tube refrigerator 101 includes a compressor 1, a first high pressure on-off valve 4 connected with an outlet port 1*a* of the compressor 1 through a first level high pressure passage 2, a first low pressure on-off valve 5 connected with an inlet port 1*b* of the compressor 1 through a first level low pressure passage 3, a regenerator 8 having a low temperature end 8*a* and a high temperature end 8*b*. The regenerator 8 is connected with the first high pressure on-off valve 4 through a regenerator side high pressure passage 6 at the high temperature end 8*b* of the regenerator 8 and with the first low pressure on-off valve 5 through a regenerator side low pressure passage 7. The pulse tube refrigerator 101 further includes a cold head 9 connected with the low temperature end 8*a* of the regenerator 8, a pulse tube 10 having a low temperature end 10*a* and high temperature end 10*b* and connected with the cold head 9 at the low temperature end 10*a* thereof, a second high pressure on-off valve 11 connected with a radiator 15 attached to the high temperature end 10*b* through a pulse tube side high pressure passage 16, a second low pressure on-off valve 12 connected with the radiator 15 through a pulse tube side low pressure passage 17, a second level high pressure passage 13 connected with the first level high pressure passage 2 at one end and connected with the second high pressure on-off valve 11 at the other end, and a second level low pressure passage 14 connected with the first level low pressure passage 3 at one end and connected with the second low pressure on-off valve 12 at the other end.

The space defined by the four valves (first high pressure on-off valve 4, second high pressure on-off valve 11, first low pressure on-off valve 5 and second low pressure on-off valve 12) and the compressor 1 operates as a working space (or an operating space) of the pulse tube refrigerator 101.

In this embodiment, the regenerator side high pressure passage 6 and the regenerator side low pressure passage 7 are merged together and connected with the regenerator 8 in one passage line. The two passages 6 and 7 may instead be separately connected with the regenerator 8. Similarly, the pulse tube side high pressure passage 16 and the pulse tube side low pressure passage 17 are merged together and connected with the pulse tube 10 in one passage line. The two passages 16 and 17 may instead be separately connected with the pulse tube 10.

A high pressure side piston unit 20 is disposed in the second level high pressure passage 13. This high pressure side piston unit 20 includes a high pressure side cylinder 21. A high pressure side piston 24 is reciprocally disposed in the high pressure side cylinder 21. A piston ring 25 is attached to the outer peripheral portion of the piston 24 and slidably contacts the cylinder wall to divide the high pressure side cylinder 2 into two spaces, i.e., a first cylinder high pressure space 22 and a second cylinder high pressure space 23. The fluid communication between the two spaces 22 and 23 is thus interrupted so that the operating gas in each space cannot flow into the other space. The piston 24 and piston ring 25 form a high pressure side partition element, which is a high pressure line partition means for fluidically sealing the outlet of said compressor from the high temperature end of the pulse tube while permitting pressure equalization in the high pressure passage.

One end surface of the high pressure side piston 24 is connected with one end of a spring 26. The other end of the spring 26 is secured to the inner peripheral portion of the high pressure side cylinder 21 and elastically supports the high pressure side piston 24. The first cylinder high pressure space 22 defined by the piston 24 and piston ring 25 is in fluid communication with the first level high pressure passage 2 through the second level high pressure passage 13, and the second cylinder high pressure space 23 is in fluid communication with the second high pressure on-off valve 11 through the second level high pressure passage 13.

A low pressure side piston unit 30 is disposed in the second level low pressure passage 14. This low pressure side piston unit 30 includes a low pressure side cylinder 31. A low pressure side piston 34 is reciprocally disposed in the low pressure side cylinder 31. A piston ring 35 is attached to the outer peripheral portion of the piston 34 and slidably contacts the cylinder wall to divide the low pressure side cylinder 31 into two spaces, i.e., a first cylinder low pressure space 32 and a second cylinder low pressure space 33. The fluid communication between the two spaces 32 and 33 is thus interrupted so that the operating gas in each space cannot flow into the other space. The low pressure side piston 34 and piston ring 35 form a low pressure side partition element, which is a low pressure line partition means for fluidically sealing the outlet of said compressor from the low temperature end of the pulse tube while permitting pressure equalization in the low pressure passage.

One end surface of the low pressure side piston 34 is connected with one end of a spring 36. The other end of the spring 36 is secured to an inner peripheral portion of the low pressure side cylinder 31 and elastically supports the low pressure side piston 34. The first cylinder low pressure space 32 defined by the piston 34 and piston ring 35 is in fluid communication with the first level low pressure passage 3 through the second level low pressure passage 14, and the second cylinder low pressure space 33 is in fluid communication with the second low pressure on-off valve 12 through the second level low pressure passage 14.

Figure 2:
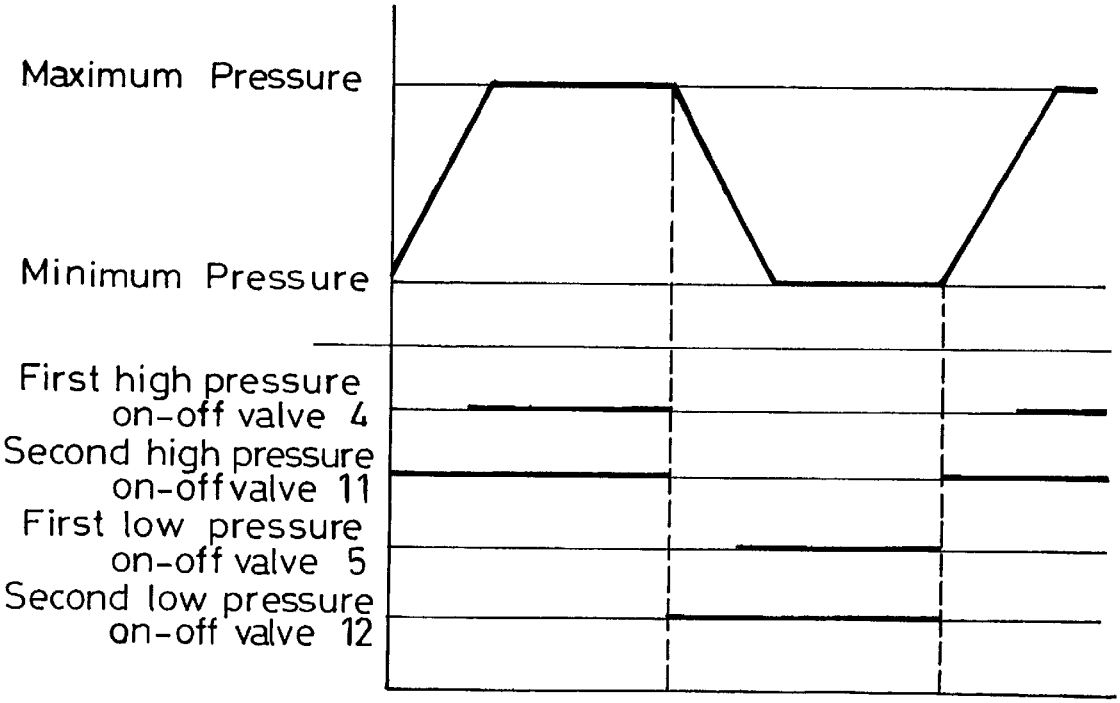
FIG. 2 is a graph illustrating on-off conditions of first high pressure on-off valve, a second high pressure on-off valve, a first low pressure on-off valve, and a second low pressure on-off valve during pulse tube refrigerator operation with a pressure change condition in the operating space of the pulse tube refrigerator in FIG. 1.

FIG. 2 is a graph showing the timewise on-off operations of the first high pressure on-off valve 4, the second high pressure on-off valve 11, the first low pressure on-off valve 5 and the second low pressure on-off valve 12 during operation of the refrigerator 101. The timewise pressure conditions in the operating space (mainly the space in the pulse tube) is also illustrated in FIG. 2. In the graph, the bold lines show the valve on conditions and the fine lines show the valve off conditions.

In the pulse tube refrigerator 101 of this embodiment, the pressure level in the second cylinder high pressure space 23 and the part of the second level high pressure passage 13 connected thereto is approximately the same level as the pressure level in the first cylinder high pressure space 22 and the other part of the second level high pressure passage 13 connected thereto during operation of the refrigerator 101. The pressure in the first cylinder high pressure space 22 is raised to the pressure level at the outlet pressure of the compressor 1 by communicating with the first high pressure passage 2. This means that the pressure level in the spaces 22 and 23 and the second high pressure passage 13 is substantially the maximum pressure level of the operating cycle.

The pressure level in the second cylinder low pressure space 33 and the part of the second level low pressure passage 14 connected thereto is approximately the same level as the pressure level in the first cylinder low pressure space 32 and the other part of the second level low pressure passage 14 connected thereto during operation of the refrigerator 101. The pressure in the first cylinder low pressure space 32 is decreased to the pressure level at the inlet pressure of the compressor 1 by communicating with the first low pressure passage 3. This means that the pressure level in the spaces 32 and 33 and the second low pressure passage 14 is substantially the minimum pressure level of the operating cycle.

In operation, when the second high pressure on-off valve 11 is open, high pressure operating gas in the second cylinder high pressure space 23 flows into the operating space through the second high pressure on-off valve 11, and the pressure in the operating space is increased. Accordingly, the pressure in the second cylinder high pressure space 23 is decreased to create a pressure difference between the first and second cylinder high pressure spaces 22 and 23 (pressure in the first cylinder high pressure space 22 is higher than the pressure in the second cylinder high pressure space 23), and the high pressure side piston 24 is moved in the right direction as shown in FIG. 1 due to the pressure difference. The piston 24 stops its movement when the pressure difference and the elastic force of the spring 26 become balanced.

Next, the first and second high pressure on-off valves 4 and 11 are closed and the second low pressure on-off valve 12 is opened. The operating gas at the maximum pressure in the operating space flows into the second cylinder low pressure space 33 from the operating space through the second low pressure on-off valve 12. The pressure in the operating space is decreased accordingly and the pressure in the second cylinder low pressure space 33 is increased to generate a pressure difference between the first and second cylinder low pressure spaces 32 and 33 (the pressure in the first cylinder low pressure space 32 is lower than the pressure in the second cylinder low pressure space 33). The low pressure side piston 34 is then moved in the left direction, as shown in FIG. 1, due to the pressure difference until the pressure difference and the elastic force of the spring 36 become balanced.

Further, when the first low pressure on-off valve 5 is opened, the operating gas in the operating space flows into the compressor 1 through the first low pressure on-off valve 5 and the inlet port 1*b* of the compressor 1 to further reduce the pressure level in the operating space until the pressure level reaches the minimum level. Then the operating gas in the pulse tube flows in the left direction as shown in FIG. 1, and the operating gas in the second cylinder low pressure space 33 flows into the operating space through the second low pressure on-off valve 12. The low pressure side piston 34 then returns to its original position due to this pressure change. Finally the first low pressure on-off valve 5 and the second low pressure on-off valve 12 are closed to complete one cycle of the operation.

As explained, by on-off controlling the four valves, i.e., the first and the second high pressure on-off valves 4, 11 and the first and the second low pressure on-off valves 5, 12, the phase between pressure changes and the movements (displacements) of the operating gas can be controlled according to the on-off timing of the valves. Thus the refrigeration output can be generated in the pulse tube 10 and taken out through the cold head 9.

According to this embodiment of the pulse tube refrigerator 101 of the present invention, refrigeration efficiency and the stability of operation have been improved compared to the conventional four valve type pulse tube refrigerator shown in FIGS. 11 and 12. The refrigeration efficiency has been improved by decreasing the operational loss for the compressor. In the conventional refrigerator, most of the operating gas sent from the compressor 1 to pulse tube 10 through the second high pressure on-off valve 11 flows again into the compressor 1 through the second low pressure, on-off valve 12. This forces the compressor to do extra work.

According to the refrigerator 101 of the invention, the high pressure side piston unit and the low pressure side piston unit are positioned to interrupt unnecessary flow communication in the refrigeration system. The high pressure side piston unit 20 includes the high pressure side piston 24 and piston ring 25 to form a high pressure side partition element, while the low pressure side piston unit 30 includes the low pressure side piston 34 and piston ring 35 to form a low pressure side partition element. These partition elements disposed in the fluid passage prevent unnecessary fluid return to the compressor.

Figure 3:
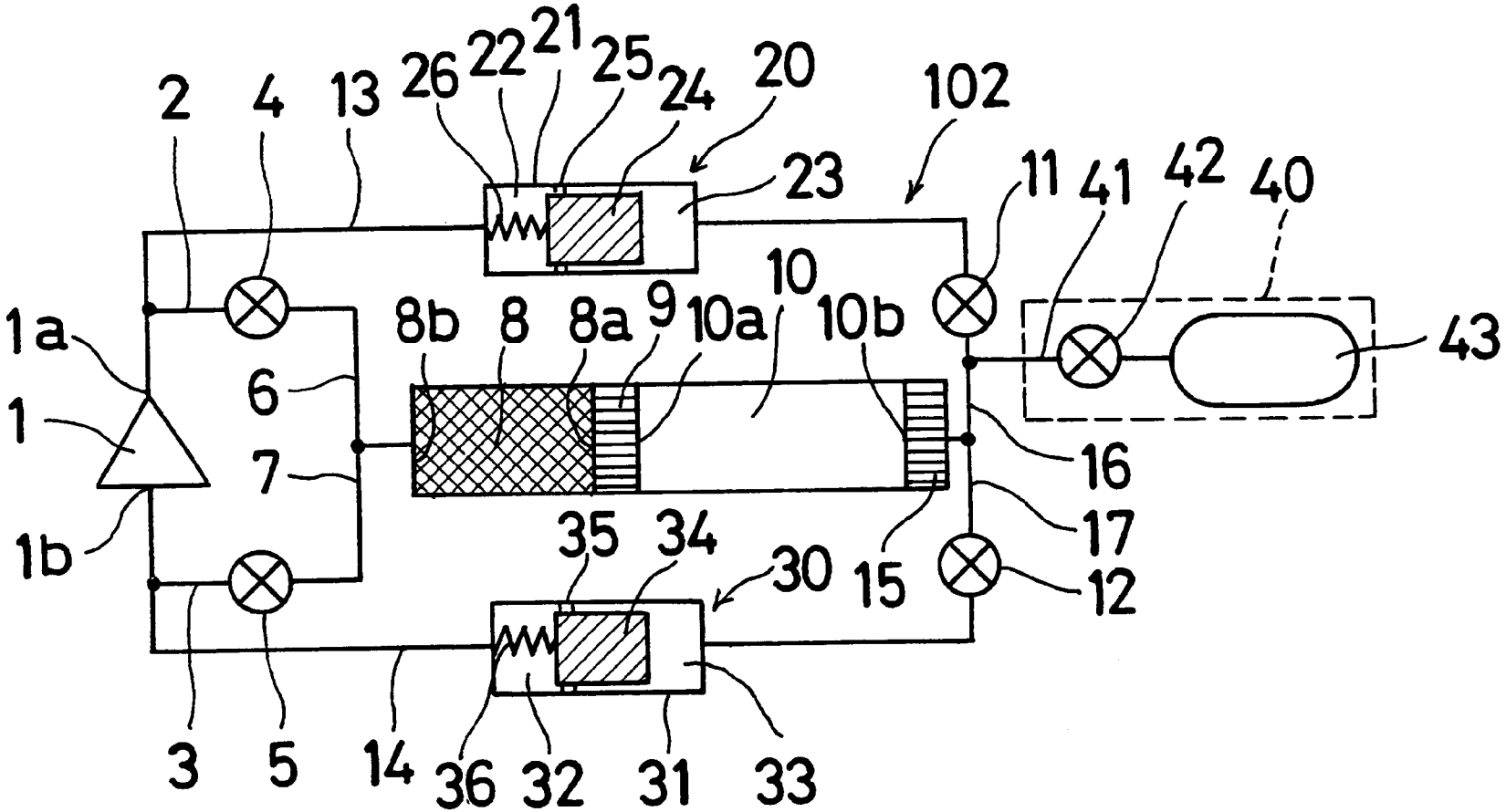
FIG. 3 shows a structural concept of a pulse tube refrigerator of a second embodiment of the present invention.
Figure 4:
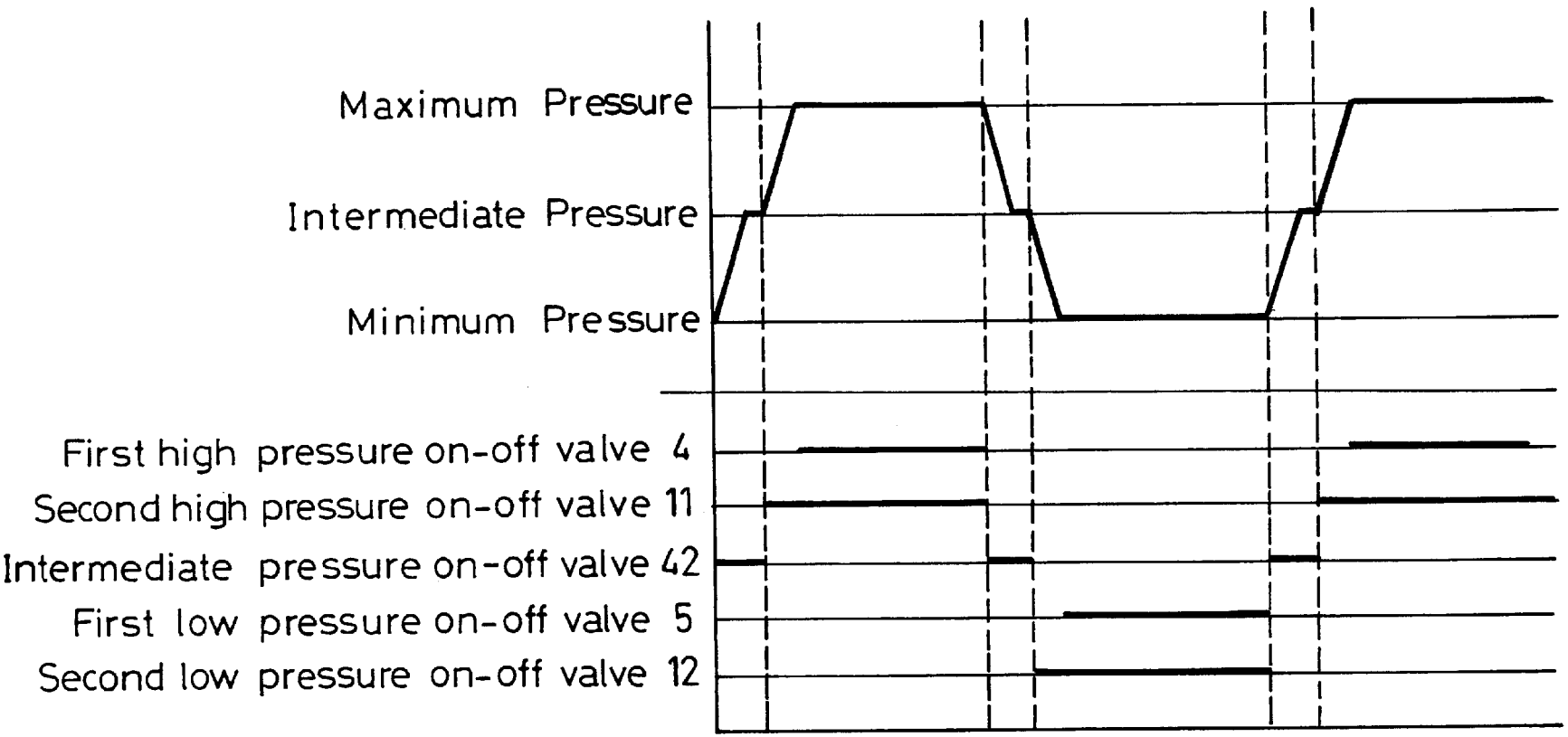
FIG. 4 is a graph illustrating on-off conditions of a first high pressure on-off valve, a second high pressure on-off valve, an intermediate pressure on-off valve, a first low pressure on-off valve, and a second low pressure on-off valve under the pulse tube refrigerator operation with a pressure change condition in the operating-space of the pulse tube refrigerator in FIG. 3.

Referring now to the second embodiment of the invention with the reference to FIGS. 3, 4, FIG. 3 shows a pulse tube refrigerator 102. The pulse tube refrigerator 102 includes basically the same or similar structure as the pulse tube refrigerator 101, with some additional elements. The pulse tube refrigerator 102 includes an intermediate pressure unit 40 disposed in the pulse tube side high pressure passage 16. The other parts with same reference numbers to those in FIG. 1 are the same or similar to the elements in the pulse tube refrigerator 101 of FIG. 1 and the explanation thereof will be omitted.

The intermediate pressure unit 40 is a means for establishing an intermediate pressure in at least one of said high pressure passage and said low pressure passage, and includes an intermediate pressure passage 41 connected to the pulse tube side high pressure passage 16, an intermediate pressure on-off valve 42 disposed in the intermediate pressure passage 41 and an intermediate pressure buffer tank 43 connected to the intermediate pressure passage 41 at the other end thereof. The pressure level in the intermediate pressure buffer tank 43 is approximately at an intermediate level between the output pressure from the compressor (maximum pressure in the operating space) and the inlet pressure into the compressor (minimum pressure in the operating space).

FIG. 4 is a graph showing the timewise on-off operations of the first high pressure on-off valve 4, the second high pressure on-off valve 11, the first low pressure on-off valve 5, the second low pressure on-off valve 12 and the intermediate pressure on-off valve 42 during operation of the refrigerator 102. The timewise pressure conditions in the operating space (mainly the space in the pulse tube) are also illustrated in FIG. 4. In the graph, the bold lines show the valve on conditions and the fine lines show the valve off conditions.

In the pulse tube refrigerator 102 of this embodiment, the pressure level in the second cylinder high pressure space 23 and a part of the second level high pressure passage 13 connected thereto is approximately the same as the pressure level in the first cylinder high pressure space 22 and the other part of the second level high pressure passage 13 connected thereto during operation of the refrigerator 102. The pressure in the first cylinder high pressure space 22 is raised to the pressure level at the outlet pressure of the compressor 1 by communicating with the first high pressure passage 2. This means that the pressure level in the spaces 22 and 23 and the second high pressure passage 13 is substantially the maximum pressure level of the operating cycle.

The pressure level in the second cylinder low pressure space 33 and a part of the second level low pressure passage 14 connected thereto is approximately the same as the pressure level in the first cylinder low pressure space 32 and the other part of the second level low pressure passage 14 connected thereto during operation of the refrigerator 102. The pressure in the first cylinder low pressure space 32 is decreased to the pressure level at the inlet pressure of the compressor 1 by communicating with the first low pressure passage 3. This means that the pressure level in the spaces 32 and 33 and the second low pressure passage 14 is substantially the minimum pressure level of the operating cycle.

Under these conditions, when the intermediate pressure on-off valve 42 is opened in the condition that the pressure level in the operating space is at a minimum level, the operating gas in the intermediate pressure buffer tank 43 flows into the operating space through the intermediate pressure on-off valve, and the pressure in the operating space increases from the minimum to an intermediate level.

Further, after the closure of the intermediate pressure on-off valve, when the second high pressure on-off valve 11 is opened, the high pressure operating gas in the second cylinder high pressure space 23 flows into the operating space through the second high pressure on-off valve 11, thereby to further increase the pressure in the operating space. According to the increase of pressure in the operating space, the pressure in the second cylinder high pressure space 23 decreases and a pressure difference occurs between the first cylinder high pressure space 22 and the second cylinder high pressure space 23 (the pressure in the first cylinder high pressure space 22 is greater than that of the second cylinder high pressure space). Due to this pressure difference, the high pressure side piston 24 moves in the right direction as shown in FIG. 3. This piston movement stops when the pressure difference and the elastic force of the spring 26 become balanced.

Further, when the first high pressure on-off valve 4 is opened, the high pressure operating gas flows into the operating space through the first high pressure on-off valve 4, and the high pressure in the operating space increases until it reaches the maximum pressure level. Then the operating gas in the pulse tube 10 flows in the right direction as shown in FIG. 3, and further flows into the second cylinder high pressure space 23 from the pulse tube 10 through the second high pressure on-off valve 11 to return the piston 24 to its original position. Then, the first and second high pressure on-off valves 4, 11 are closed and the intermediate pressure on-off valve 42 is open. The operating gas at its maximum pressure condition in the operating space flows into the intermediate pressure buffer tank 43 thereby to reduce the pressure in the operating space from the maximum level to the intermediate level.

Next, the intermediate pressure on-off valve 42 is closed and the operating gas at the intermediate pressure level in the operating space flows into the second cylinder low pressure space 33 from the operating space through the second low pressure on-off valve 12. The pressure in the operating space is decreased accordingly and the pressure in the second cylinder low pressure space 33 is increased to generate a pressure difference between the first and second cylinder low pressure spaces 32 and 33 (the pressure in the first cylinder low pressure space 32 is lower than the pressure in the second cylinder low pressure space 33). The low pressure side piston 34 then moves in the left direction as shown in FIG. 3 due to the pressure difference until the pressure difference and the elastic force of the spring 36 become balanced.

Further, when the first low pressure on-off valve 5 is opened, the operating gas in the operating space flows into the compressor 1 through the first low pressure on-off valve 5 and the inlet port 1*b* of the compressor 1 to further reduce the pressure level in the operating space until the pressure level reaches the minimum level. Then the operating gas in the pulse tube flows in the left direction as shown in FIG. 3, and the operating gas in the second cylinder low pressure space 33 flows into the operating space through the second low pressure on-off valve 12. The low pressure side piston 34 then returns to its original position due to this pressure change. Finally the first low pressure on-off valve 5 and the second low pressure on-off valve 12 are closed to complete one cycle of operation.

As explained, by on-off controlling the five valves, i.e., the first and second high pressure on-off valves 4, 11, the first and second low pressure on-off valves 5, 12 and the intermediate pressure on-off valve 42, the phase between pressure changes and the movements (displacements) of the operating gas can be controlled according to the on-off timing of the valves. Thus the refrigeration output can be generated in the pulse tube 10 and taken out through the cold head 9.

The pulse tube refrigerator 102 of the present invention is superior to the conventional pulse tube refrigerator 201 shown in FIG. 11 in efficiency of refrigeration and stability of operation as explained in the first embodiment of the invention. The pulse tube refrigerator 102 of this embodiment is more efficient in refrigeration than that of the first embodiment. This is because the refrigerator 102 is provided with the intermediate pressure unit 40 which can increase and keep the pressure in the operating space to an intermediate pressure level before the second high pressure on-off valve 11 is opened. The pressure difference between the upper and lower areas of the second high pressure on-off valve 11 (the pressure difference between the operating space and the second level high pressure passage 13) at the time of opening of the valve 11 is smaller than that of the pulse tube refrigerator 101 of the first embodiment. This will further reduce the valve loss at the high pressure valve 11 compared to the first embodiment. The valve loss is an irreversible energy loss which is larger when the pressure difference at the valve on-off operation is large. This loss will lead to an increase of the amount of work of the compressor. Similarly, the valve loss at the other high pressure on-off valve 12 can be reduced for the same reason.

Figure 5:
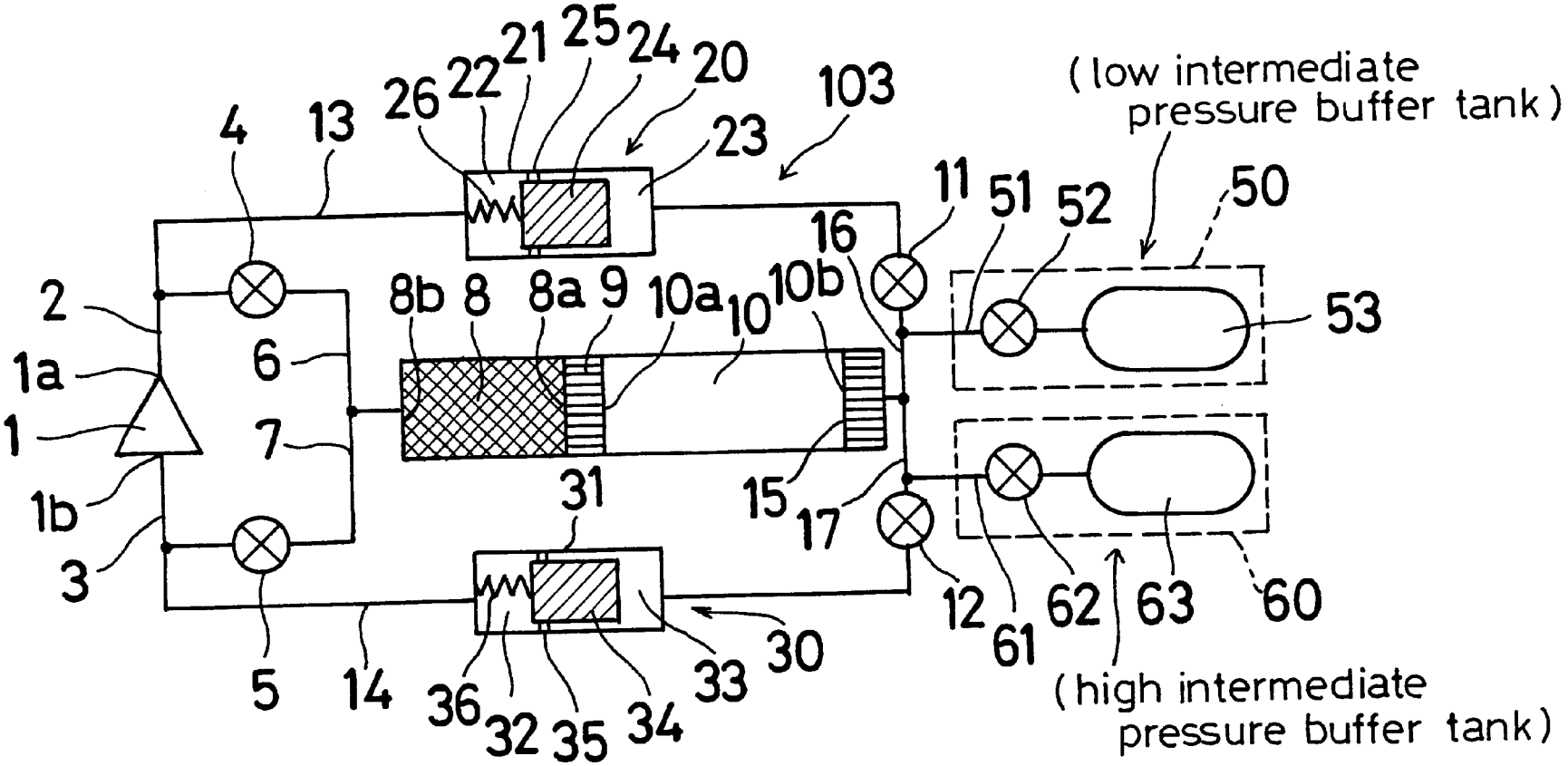
FIG. 5 shows a structural concept of a pulse tube refrigerator of a third embodiment of the present invention.

Next referring to a third embodiment of the present invention with the reference to FIG. 5, FIG. 5 shows a pulse tube refrigerator 103 which is basically the same as the refrigerator 101 in the first embodiment except for the following:

The pulse tube refrigerator 103 further includes a plurality of intermediate pressure units (the embodiment shown in FIG. 5 illustrates two units as an example). A first intermediate pressure unit 50 is disposed in the pulse tube side high pressure passage 16 and a second intermediate pressure unit 60 is disposed in the pulse tube side low pressure passage 17. Both units 50, 60 are connected to the high temperature end 10*b* through the passages 16 and 17, respectively. The first intermediate pressure unit 50 includes a first intermediate pressure passage 51 connected to the pulse tube side high pressure passage 16 at one end, a first intermediate pressure on-off valve 52 disposed in the first intermediate pressure passage 51 and a first intermediate pressure buffer tank 53 connected to the other end of the first intermediate pressure passage 51. The second intermediate pressure unit 60 includes a second intermediate pressure passage 61 connected to the pulse tube side low pressure passage 17 at one end, a second intermediate pressure on-off valve 62 disposed in the second intermediate pressure passage 61 and a second intermediate pressure buffer tank 63 connected to the other end of the second intermediate pressure passage 61.

The pressures in the first and second intermediate pressure units 50, 60 are set to be lower than the pressure at the outlet of the compressor 1 (the maximum pressure in the operating space) and higher than the pressure at the inlet of the compressor 1 (the minimum pressure in the operating space).

The pressure in the first intermediate pressure buffer tank 53 is set to be lower than that in the second intermediate pressure buffer tank 63. Preferably, the pressure values of the outlet and inlet pressures of the compressor 1 and pressure values of the first and second intermediate pressure buffer tanks 53, 63 have the following relations. Supposing the pressure at the outlet of compressor 1 is $P_H$ and pressure at the inlet of compressor 1 is $P_L$, the pressure in the first intermediate pressure buffer tank is set to be: $(P_H+2\ P_L)/3$ and the pressure in the second intermediate pressure buffer tank is set to be: $(2P_H+P_L)/3$. In other words, the pressures in the first and second intermediate pressure buffer tanks 53, 56 are respectively set at one third and two thirds of the difference between the pressures $P_H$ and $P_L$.

Figure 6:
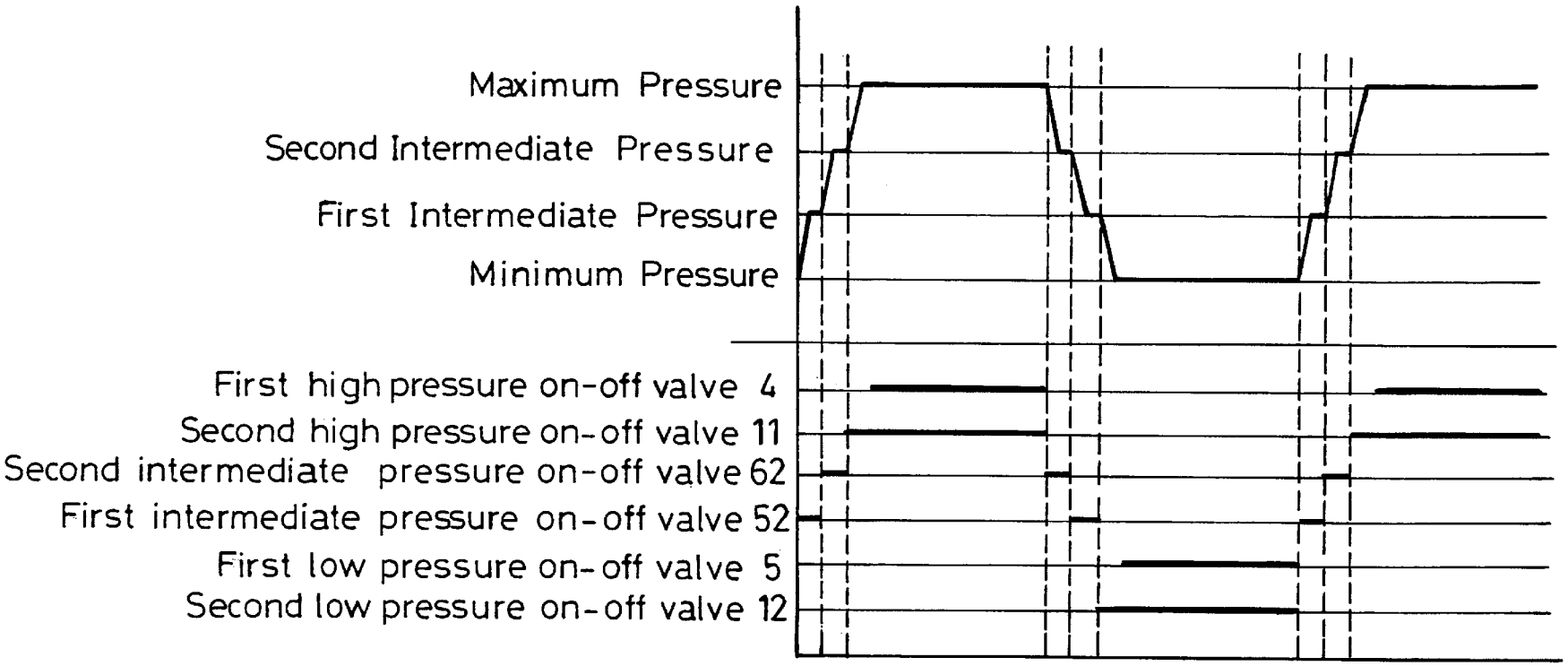
FIG. 6 is a graph illustrating on-off conditions of a first high pressure on-off valve, a second high pressure on-off valve, a first intermediate pressure on-off valve, a second intermediate pressure on-off valve, a first low pressure on-off valve, and a second low pressure on-off valve under the pulse tube refrigerator operation with a pressure change condition in the operating space of the pulse tube refrigerator in FIG. 5.

FIG. 6 is a graph showing the timewise on-off operations of the first high pressure on-off valve 4, the second high pressure on-off valve 11, the first low pressure on-off valve 5, the second low pressure on-off valve 12, and the first and second intermediate pressure on-off valves 52, 62 during operation of the refrigerator 103. The timewise pressure conditions in the operating space (mainly the space in the pulse tube) is also illustrated in FIG. 6. In the graph, bold lines show valve on conditions and the fine lines show the valve off conditions.

In the pulse tube refrigerator 103 of this embodiment, the pressure level in the second cylinder high pressure space 23 and the part of the second level high pressure passage 13 connected thereto is approximately the same as the pressure level in the first cylinder high pressure space 22 and the other part of the second level high pressure passage 13 connected thereto during operation of the refrigerator 103. The pressure in the first cylinder high pressure space 22 is raised to the pressure level at the outlet pressure of the compressor 1 by communicating with the first high pressure passage 2. This means that the pressure level in the spaces 22 and 23 and the second high pressure passage 13 is substantially the maximum pressure level of the operating cycle.

The pressure level in the second cylinder low pressure space 33 and the part of the second level low pressure passage 14 connected thereto is approximately the same as the pressure level in the first cylinder low pressure space 32 and the other part of the second level low pressure passage 14 connected thereto during operation of the refrigerator 103.

The pressure in the first cylinder low pressure space 32 is decreased to the pressure level at the inlet pressure of the compressor 1 by communicating with the first low pressure passage 3. This means that the pressure level in the spaces 32 and 33 and the second low pressure passage 14 is substantially the minimum pressure level of the operating cycle.

Under these conditions, when the first intermediate pressure on-off valve 52 is opened from the condition that the pressure level in the operating space is at a minimum level, the operating gas in the first intermediate pressure buffer tank 53 flows into the operating space from the first intermediate pressure on-off valve 52 and the pressure in the operating space increases from the minimum to a first intermediate level (approximately the pressure level of the first intermediate pressure buffer tank 53).

Further, after the closure of the first intermediate pressure on-off valve 52, when the second intermediate pressure on-off valve 62 is opened, the operating gas in the second intermediate pressure buffer tank 63 flows into the operating space through the second intermediate pressure on-off valve 62 thereby to further increase the pressure in the operating space to a second intermediate pressure approximately the same as the pressure in the second intermediate pressure buffer tank.

Further, after the closure of the second intermediate pressure on-off valve 62, when the second high pressure on-off valve 11 is opened, the operating gas in the second cylinder high pressure space 23 flows into the operating space thereby to further increase the pressure in the operating space.

According to the increase of pressure in the operating space, the pressure in the second cylinder high pressure space 23 decreases and the pressure difference occurs between the first cylinder high pressure space 22 and the second cylinder high pressure space 23 (the pressure in the first cylinder high pressure space 22 is greater than that of the second cylinder high pressure space). Due to this pressure difference, the high pressure side piston 24 moves the right direction as shown in FIG. 3. This piston movement stops when the pressure difference and the elastic force of the spring 26 become balanced.

Further, when the first high pressure on-off valve 4 is opened, high pressure operating gas flows into the operating space through the first high pressure on-off valve 4 and the high pressure in the operating space increases until it reaches the maximum pressure level. Then the operating gas in the pulse tube 10 flows in the right direction as shown in FIG. 3, and further flows into the second cylinder high pressure space 23 from the pulse tube 10 through the second high pressure on-off valve 11 to return the piston 24 to its original position.

Then, the first and second high pressure on-off valves 4, 11 are closed and the second intermediate pressure on-off valve 62 is opened. The operating gas at its maximum pressure condition in the operating space flows into the second intermediate pressure buffer tank 63, thereby to reduce the pressure in the operating space from the maximum level to the second intermediate level.

Next, the second intermediate pressure on-off valve 62 is closed and the first intermediate pressure on-off valve 52 is opened, the operating gas at the second intermediate pressure level in the operating space flows into the first intermediate pressure buffer tank 53 from the operating space through the first intermediate pressure on-off valve 52. The pressure in the operating space is thus decreased from the second intermediate level to the first intermediate level.

Then, the first intermediate pressure on-off valve 52 is closed and the second low pressure on-off valve 12 is opened, and the operating gas at the first intermediate pressure level in the operating space flows into the second cylinder low pressure space 33 from the operating space through the second low pressure on-off valve 12. The pressure in the operating space is decreased and accordingly the pressure in the second cylinder low pressure space 33 is increased to generate a pressure difference between the first and second cylinder low pressure spaces 32 and 33 (the pressure in the first cylinder low pressure space 32 is lower than the pressure in the second cylinder low pressure space 33). The low pressure side piston 34 is then moved in the left direction as shown in FIG. 5, due to the pressure difference, until the pressure difference and the elastic force of the spring 36 become balanced.

Further, when the first low pressure on-off valve 5 is opened, the operating gas in the operating space flows into the compressor 1 through the first low pressure on-off valve 5 and the inlet port 1*b* of the compressor 1 to further reduce the pressure level in the operating space until the pressure level reaches the minimum level. Then the operating gas in the pulse tube flows in the left direction as shown in FIG. 5, and the operating gas in the second cylinder low pressure space 33 flows into the operating space through the second low pressure on-off valve 12. The low pressure side piston 34 then returns to its original position due to this pressure-change. Finally the first low pressure on-off valve 5 and the second low pressure on-off valve 12 are closed to complete one cycle of operation.

As explained, by on-off controlling the six valves, i.e., the first and second high pressure on-off valves 4, 11, the first and second low pressure on-off valves 5, 12 and the first and second intermediate pressure on-off valves 52, 62 the phase between pressure changes and the movements (displacements) of the operating gas can be controlled according to the on-off timing of the valves. Thus the refrigeration output can be generated in the pulse tube 10 and taken out through the cold head 9.

The pulse tube refrigerator 103 of the present invention is superior to the conventional pulse tube refrigerator 201 shown in FIG. 11 in the efficiency of refrigeration and the stability of operation as explained in the first embodiment of the invention. The pulse tube refrigerator 103 of this embodiment is more efficient in refrigeration than those of the first and second embodiments. This is because the refrigerator 103 is provided with the first and second intermediate pressure units 50, 60 which can keep the pressure in the operating space at the first and second intermediate pressure levels before the second high pressure on-off valve 11 is opened. The pressure difference across the second high pressure on-off valve 11 (the pressure difference between the operating space and the second level high pressure passage 13) at the time of opening of the valve 11 is thereby smaller than those of the pulse tube refrigerators 101, 102 of the previous embodiments. This will further reduce the valve loss at the high pressure valve 11 compared to the previous embodiments. The valve loss is an irreversible energy loss which is larger when the pressure difference at the valve on-off operation is large, as previously explained in the second embodiment. This loss will lead to an increase of the amount of work of the compressor. Similarly, the valve loss at the other high pressure on-off valve 12 can be reduced for the same reason.

Figure 7:
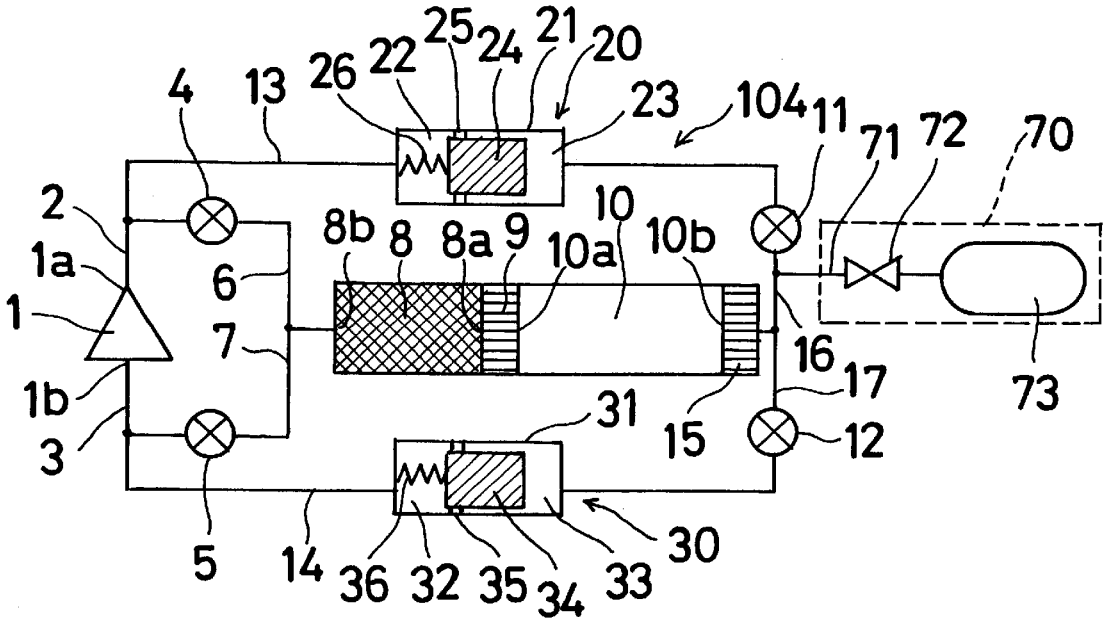
FIG. 7 shows a structural concept of a pulse tube refrigerator of a fourth embodiment of the present invention.
Figure 8:
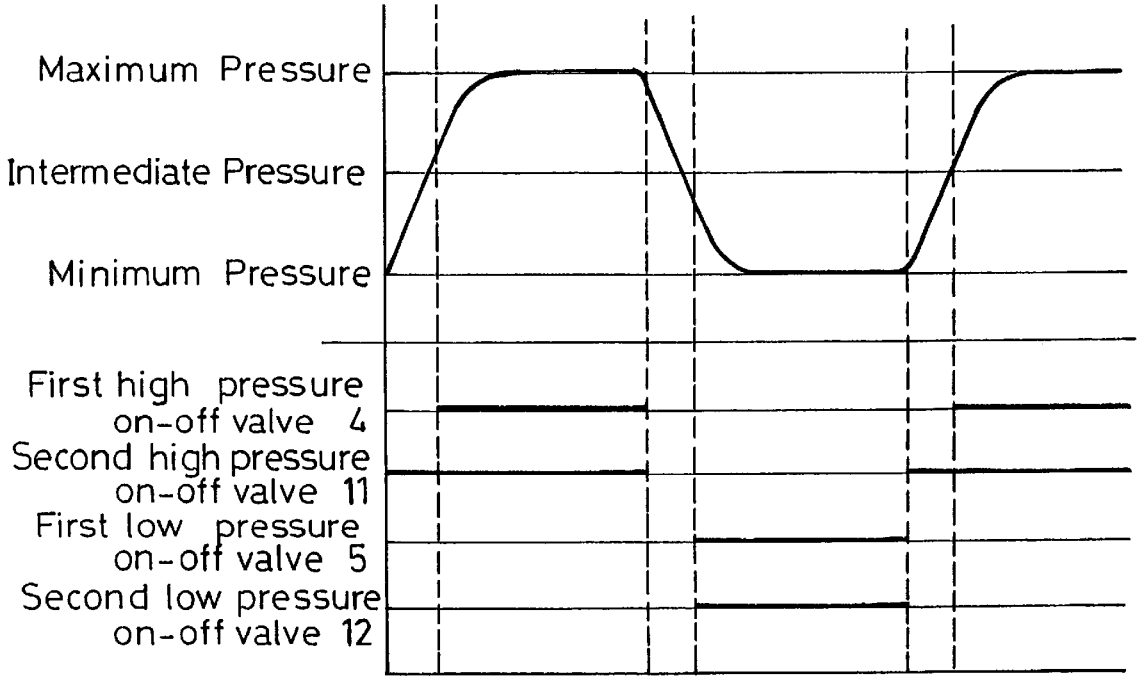
FIG. 8 is a graph illustrating on-off conditions of a first high pressure on-off valve, a second high pressure on-off valve, a first low pressure on-off valve, and a second low pressure on-off valve under the pulse tube refrigerator operation with a pressure change condition in the operating space of the pulse tube refrigerator in FIG. 7.

Referring now to the fourth embodiment of the invention with reference to FIGS. 7, 8, FIG. 7 shows a pulse tube refrigerator 104, the pulse tube refrigerator 104 including basically the same or similar structure to the pulse tube refrigerators already explained in the previous embodiments, with only some minor differences. The pulse tube refrigerator 104 includes an intermediate pressure unit 70 disposed in the pulse tube side high pressure passage 16. The other parts with same reference numbers to those in FIG. 3 are the same or similar to the elements in the pulse tube refrigerator 102 of FIG. 1 and their explanation will be omitted.

The intermediate pressure unit 70 includes an intermediate pressure passage 71 connected to the pulse tube side high pressure passage 16, an orifice valve 72 disposed in the intermediate pressure passage 71 and an intermediate pressure buffer tank 73 connected to the intermediate-pressure passage 71 at the other end thereof. The pressure level in the intermediate pressure buffer tank 73 is approximately the intermediate level between the output pressure from the compressor (maximum pressure in the operating space) and the inlet pressure into the compressor (minimum pressure in the operating space).

FIG. 8 is a graph showing the timewise on-off operations of the first high pressure on-off valve 4, the second high pressure on-off valve 11, the first low pressure on-off valve 5 and the second low pressure on-off valve 12 during operation of the refrigerator 104. The timewise pressure conditions in the operating space (mainly the space in the pulse tube) are also illustrated in FIG. 8. In the graph, the bold lines show the valve on conditions and the fine lines show the valve off conditions.

In the pulse tube refrigerator 104 of this embodiment, the pressure level in the second cylinder high pressure space 23 and the part of the second level high pressure passage 13 connected thereto is approximately the same level as the pressure level in the first cylinder high pressure space 22 and the other part of the second level high pressure passage 13 connected thereto during operation of the refrigerator 104. The pressure in the first cylinder high pressure space 22 is raised to the pressure level at the outlet pressure of the compressor 1 by communicating with the first high pressure passage 2. This means that the pressure level in the spaces 22 and 23 and the second high pressure passage 13 is substantially the maximum pressure level of the operating cycle.

The pressure level in the second cylinder low pressure space 33 and the part of the second level low pressure passage 14 connected thereto is approximately the same as the pressure level in the first cylinder low pressure space 32 and the other part of the second level low pressure passage 14 connected thereto during operation of the refrigerator 104.

The pressure in the first cylinder low pressure space 32 is decreased to the pressure level at the inlet pressure of the compressor 1 by communicating with the first low pressure passage 3. This means that the pressure level in the spaces 32 and 33 and the second low pressure passage 14 is substantially the minimum pressure level of the operating cycle.

In operation, when the second high pressure on-off valve 11 is opened, high pressure operating gas in the second cylinder high pressure space 23 flows into the operating space through the second high pressure on-off valve 11 and the pressure in the operating space is increased. Accordingly, the pressure in the second cylinder high pressure space 23 is decreased to create a pressure difference between, the first and second cylinder high pressure spaces 22 and 23 (pressure in the first cylinder high pressure space 22 is higher than the pressure in the second cylinder high pressure space 23) and the high pressure side piston 24 is moved in the right direction as shown in FIG. 7 due to the pressure difference. The piston 24 stops its movement when the pressure difference and the elastic force of the spring 26 become balanced.

Further, when the first high pressure on-off valve 4 is opened, the high pressure operating gas flows into the operating space through the first high pressure on-off valve 4 and the high pressure in the operating space increases until it reaches the maximum pressure level. Then the operating gas in the pulse tube 10 flows in the right direction as shown in FIG. 7, and further flows into the second cylinder high pressure space 23 from the pulse tube 10 through the second high pressure on-off valve 11 to return the piston 24 to its original position.

During the above operation, the operating gas in the operating space keeps gradually flowing into the intermediate pressure buffer tank 70 through the orifice valve 72 until it reaches the maximum level. This gradual increase of the pressure results in the gradual movement of the operating gas in the pulse tube 10, and accordingly the operating gas moves further in the right direction from the pulse tube 10 as compared to the previous embodiments.

Next, the first and second high pressure on-off valves 4 and 11 are closed and the second low pressure on-off valve 12 is open. The operating gas at the maximum pressure in the operating space flows into the second cylinder low pressure space 33 from the operating space through the second low pressure on-off valve 12. The pressure in the operating space is decreased accordingly and the pressure in the second cylinder low pressure space 33 is increased to generate a pressure difference between the first and second cylinder low pressure spaces 32 and 33 (the pressure in the first cylinder low pressure space 32 is lower than the pressure in the second cylinder low pressure space 33). The low pressure side piston 34 is then moved in the left direction as shown in FIG. 7 due to the pressure difference until the pressure difference and the elastic force of the spring 36 become balanced.

Further, when the first low pressure on-off valve 5 is opened, the operating gas in the operating space flows into the compressor 1 through the first low pressure on-off valve 5 and the inlet port 1*b* of the compressor 1 to further reduce the pressure level in the operating space until the pressure level reaches to the minimum level. Then the operating gas in the pulse tube 10 flows in the left direction as shown in FIG. 7, and the operating gas in the second cylinder low pressure space 33 flows into the operating space through the second low pressure on-off valve 12. The low pressure side piston 34 then returns to its original position due to this pressure change.

During the above operation, the operating gas in the operating space keeps gradually flowing into the intermediate pressure buffer tank 70 through the orifice valve 72 until it reaches the minimum level. This gradual decrease of the pressure results in the gradual movement of the operating gas in the pulse tube 10, and accordingly the operating gas moves further in the left direction from the pulse tube 10 as compared to the previous embodiments.

Finally, the first low pressure on-off valve 5 and the second low pressure on-off valve 12 are closed to complete one cycle of the operation.

As explained, by on-off controlling the four valves, i.e., the first and the second high pressure on-off valves 4, 11 and the first and the second low pressure on-off valves 5, 12 the phase between pressure changes and the movements (displacements) of the operating gas can be controlled according to the on-off timing of the valves. Thus the refrigeration output can be generated in the pulse tube 10 and taken out through the cold head 9.

The pulse tube refrigerator 104 of the present invention is superior to the conventional pulse tube refrigerator 201 shown in FIG. 11 in the efficiency of refrigeration and the stability of operation as explained in the first embodiment of the invention. The pulse tube refrigerator 104 of this embodiment is more efficient in refrigeration than that of the first embodiment. This is because the refrigerator 104 is provided with the intermediate pressure unit 70 which can displace the operating gas in the pulse tube more widely. The volume displacement on the equivalent P-V line can thus be increased and the pulse tube refrigerator of this embodiment is more effective when used in a refrigerator having a lower pressure rate (rate of outlet and inlet pressure of compressor), or having a higher refrigeration temperature.

Figure 9:
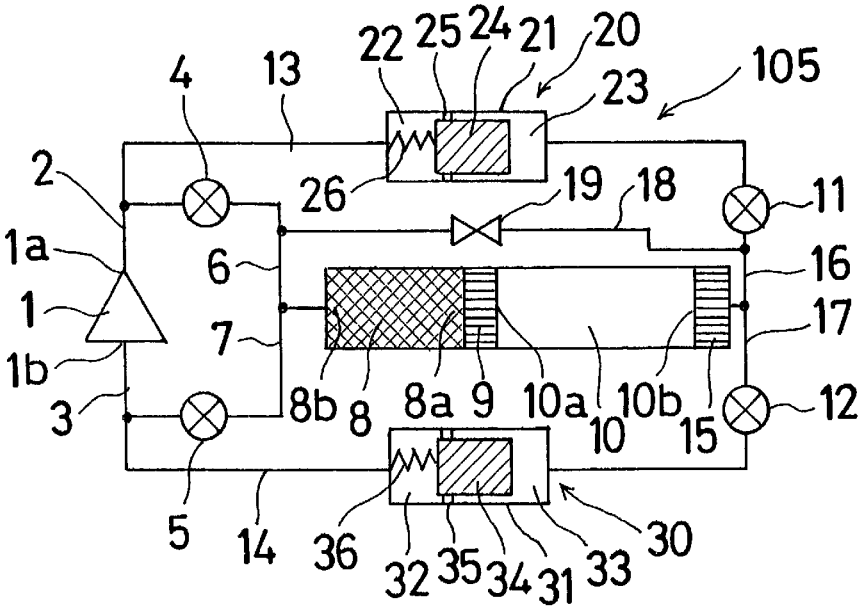
FIG. 9 shows a structural concept of a pulse tube refrigerator of a fifth embodiment of the present invention.

Referring now to the fifth embodiment of the invention with the reference to FIG. 9. FIG. 9 shows a pulse tube refrigerator 105. In the drawing, the pulse tube refrigerator 105 includes basically the same or similar structure to the pulse tube refrigerator 101, with some additional elements.

The pulse tube refrigerator 105 includes a bypass passage 18 provided between the regenerator side high pressure passage 6 and pulse tube side high pressure passage 16 to connect them for bypassing the fluid communication therebetween and a bypass orifice valve 19 disposed in the bypass passage 18. The other parts with same reference numbers to those in FIG. 1 are the same or similar to the elements in the pulse tube refrigerator 101 of FIG. 1 and their explanation will be omitted.

The bypass passage may be provided between the high temperature end 8*b* of the regenerator 8 and high temperature end 10*b* of the pulse tube 10 for connecting the regenerator 8 and pulse tube 10 to establish direct fluid communication therebetween. Also, a bypass passage may be provided between the regenerator side low pressure passage 7 and pulse tube side low pressure passage 17 for fluid communication therebetween.

The graph of FIG. 2 showing the timewise on-off operations of the valves 4, 5, 11 and 12 when the refrigerator 105 is in operation is omitted from this embodiment.

In the pulse tube refrigerator 105 of this embodiment, by circulating the operating gas in the bypass passage 18, it is possible to control the displacement of the operating gas in the pulse tube 10. It is more effective when the displacement of the operating gas should be reduced, for example when used in a pulse tube refrigerator such as cryogenic refrigerator having a higher pressure rate. Usually the cryogenic refrigerator has a higher compression rate and smaller gas displacement for avoiding the heat entry at the time of gas displacement.

Figure 10:
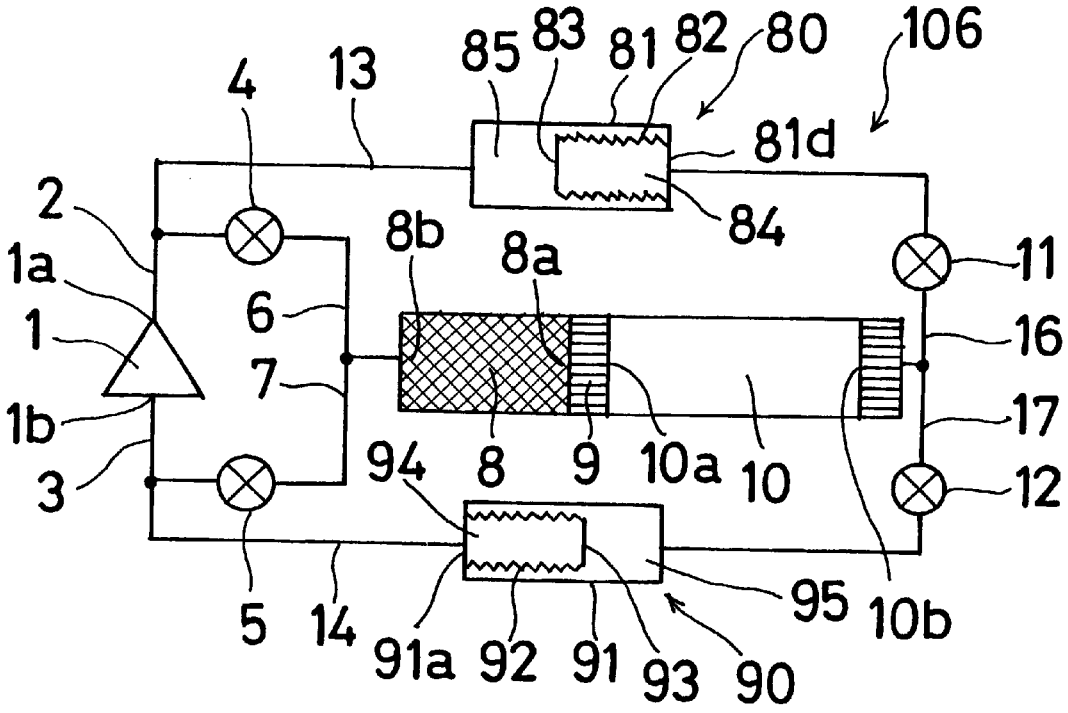
FIG. 10 shows a structural concept of a pulse tube refrigerator of a sixth embodiment of the present invention.

Referring now to the sixth embodiment of the present invention with reference to FIG. 10 in which same reference numerals used in the previous embodiments already explained above, the pulse tube refrigerator 106 includes a high pressure side piston unit 80 disposed in the second level high pressure passage 13 and a low pressure side piston unit 90 disposed in the second level low pressure passage 14. The other parts with same reference numbers to those in FIG. 1 are the same or similar to the elements in the pulse tube refrigerator 101 of FIG. 1 and their explanation will be omitted.

The high pressure side piston unit 80 includes a high pressure side cylinder 81 provided in the second level high pressure passage 13. A diaphragm 82 is disposed in the high pressure side cylinder 81. The diaphragm, which may be a bellows, 82 is extendible and contractible within the cylinder 81 in the axial direction of the cylinder 81 and securely connected to one end 81*a* of the cylinder 81 and a diaphragm bead plate 83. The diaphragm 82 is connected to the one end 81*a* of the cylinder 81 and the diaphragm head plate 83 in an air-tight manner so that the space 84 formed in the diaphragm 82 and the space 85 in the cylinder 81 are air-tightly divided to interrupt the fluid communication therebetween.

The diaphragm 82 and the diaphragm head plate 83 form the high pressure side partition element according to the invention. The space 85 in the cylinder 81 is connected to the high pressure passage 2 via the second level high pressure passage 13 while the space 84 in the diaphragm 82 is connected to the second high pressure on-off valve 11 via the second level high pressure passage 13.

The low pressure side piston unit 90 includes a low pressure side cylinder 91 provided in the second level low pressure passage 14. Another diaphragm 92 is disposed in the low pressure side cylinder 91. The diaphragm 92 is extendible and contractible within the cylinder 91 in the axial direction of the cylinder 91 and securely connected to one end 91*a* of the cylinder 91 and a diaphragm head plate 93. The diaphragm 92 is connected to the one end 91*a* of the cylinder 91 and the diaphragm head plate 93 in an air-tight manner so that the space 94 formed in the diaphragm 92 and the space 95 in the cylinder 91 are air-tightly divided to interrupt the fluid communication therebetween.

The diaphragm 92 and the diaphragm head plate 93 form the low pressure side partition element according to the invention. The space 95 in the cylinder 91 is connected to the second low pressure on-off valve 12 via the second level low pressure passage 14 while the space 94 in the diaphragm 92 is connected to low pressure passage 3 via the second level low pressure passage 14.

The graph as in FIG. 2 for showing the timewise on-off operations of the valves 4, 5, 11 and 12 during operation of the refrigerator 105 is omitted from this embodiment.

The pulse tube refrigerator 106 of the present invention is superior to the conventional pulse tube refrigerator 201 shown in FIG. 11 in the efficiency of refrigeration and the stability of operation as explained in the first embodiment of the invention. The pulse tube refrigerator 106 of this embodiment includes diaphragm members in the high and low pressure side piston units so that the sealing effect is superior to that of the previous embodiments to prevent the leakage of operating gas in the refrigerator.

The volume displacement on the equivalent P-V line can be widely obtained and the pulse tube refrigerator of this embodiment is more effective when used in a refrigerator having a lower pressure rate (rate of outlet and inlet pressure of compressor) or having a higher refrigeration temperature. According to the pulse tube refrigerator of the present invention, efficiency of refrigeration and improvement in the stability of operation can be obtained.

It is intended that the foregoing detailed description be regarded as illustrative rather than limiting and that it is understood that the following claims including all equivalents are intended to define the scope of the invention.

What is claimed is:

1. A pulse tube refrigerator including:

a compressor;

a first high pressure valve connected with an outlet port of the compressor;

a first high pressure passage connecting the outlet of the compressor with the first high pressure valve;

a first low pressure valve connected with an inlet port of the compressor;

a first low pressure passage connecting the inlet port of the compressor with the first low pressure valve;

a regenerator having a low temperature end and a high temperature end, the regenerator being connected with the first high pressure valve and the first low pressure valve at the high temperature end of the regenerator;

a cold head connected with the low temperature end of the regenerator;

a pulse tube having a low temperature end and a high temperature end and connected with the cold head at the low temperature end thereof;

a second high pressure valve connected with the high temperature end of the pulse tube;

a second low pressure valve connected with the high temperature end of the pulse tube;

a second high pressure passage connected with the first high pressure passage at one end and connected with the second high pressure valve at the other end;

a second low pressure passage connected with the first low pressure passage at one end and connected with the second low pressure valve at the other end;

a high pressure side cylinder provided in the second high pressure passage;

a high pressure side partition element reciprocally provided within the high pressure side cylinder and fluid tightly dividing the high pressure side cylinder into a first high pressure space connected with the first high pressure passage and a second high pressure space connected with the second high pressure valve;

a low pressure side cylinder provided in the second low pressure passage; and a low pressure side partition element reciprocally provided within the low pressure side cylinder and fluid tightly dividing the low pressure side cylinder into a first low pressure space connected with the first low pressure passage and a second low pressure space connected with the second low pressure valve.

2. A pulse tube refrigerator according to claim 1, further including an intermediate pressure unit which includes an intermediate pressure passage connected with the high temperature end of the pulse tube, an intermediate pressure valve disposed in the intermediate pressure passage and an intermediate pressure buffer tank connected with the intermediate pressure passage.

3. A pulse tube refrigerator according to claim 2, including a plurality of said intermediate pressure units.

4. A pulse tube refrigerator according to claim 1, further including an intermediate pressure unit which includes an intermediate pressure passage connected with the high temperature end of the pulse tube, an orifice provided in the intermediate pressure passage, and an intermediate pressure buffer tank connected with the intermediate pressure passage.

5. A pulse tube refrigerator according to claim 1, further including a bypass passage provided between the high temperature end of the regenerator and the high temperature end of the pulse tube for fluid communication therebetween, and an orifice provided in the bypass passage.

6. A pulse tube refrigerator according to claim 1, wherein the high pressure side partition element includes a high pressure piston slidably disposed in the high pressure side cylinder and fluid tightly dividing the high pressure side cylinder into the first and second high pressure spaces, and wherein the low pressure side partition element includes a low pressure piston slidably disposed in the low pressure side cylinder and fluid tightly dividing the low pressure side cylinder into the first and second low pressure spaces.

7. A pulse tube refrigerator according to claim 6, wherein the high pressure piston and the low pressure piston are formed with diaphragm members reciprocally disposed in the high pressure and low pressure side cylinders, respectively.

8. A pulse tube refrigerator including:

a compressor;

a first high pressure valve connected with an outlet port of the compressor;

a first high pressure passage connecting the outlet of the compressor with the first high pressure valve;

a first low pressure valve connected with an inlet port of the compressor;

a first low pressure passage connecting the inlet port of the compressor with the first low pressure valve;

a regenerator having a low temperature end and a high temperature end, the regenerator being connected with the first high pressure valve and the first low pressure valve at the high temperature end of the regenerator;

a cold head connected with the low temperature end of the regenerator;

a pulse tube having a low temperature end and a high temperature end and connected with the cold head at the low temperature end thereof;

a second high pressure valve connected with the high temperature end of the pulse tube;

a second high pressure passage connected with the first high pressure passage at one end and connected with the second high pressure valve at the other end;

a high pressure side cylinder provided in the second high pressure passage;

a high pressure side partition element reciprocally provided within the high pressure side cylinder and fluid tightly dividing the high pressure side cylinder into a first high pressure space connected with the first high pressure passage and a second high pressure space connected with the second high pressure valve; and an intermediate pressure unit which includes an intermediate pressure passage connected with the high temperature end of the pulse tube, an intermediate pressure valve disposed in the intermediate pressure passage and an intermediate pressure buffer tank connected with the intermediate pressure passage.

9. A pulse tube refrigerator including a compressor;

a first high pressure valve connected with an outlet port of the compressor;

a first high pressure passage connecting the outlet of the compressor with the first high pressure valve;

a first low pressure valve connected with an inlet port of the compressor;

a first low pressure passage connecting the inlet port of the compressor with the first low pressure valve;

a regenerator having a low temperature end and a high temperature end, the regenerator being connected with the first high pressure valve and the first low pressure valve at the high temperature end of the regenerator;

a cold head connected with the low temperature end of the regenerator;

a pulse tube having a low temperature end and a high temperature end and connected with the cold head at the low temperature end thereof;

a second low pressure valve connected with the high temperature end of the pulse tube, a second low pressure passage connected with the first low pressure passage at one end and connected with the second low pressure valve at the other end;

a low pressure side cylinder provided in the second low pressure passage;

a low pressure side partition element reciprocally provided within the low pressure side cylinder and fluid tightly dividing the low pressure side cylinder into a first low pressure space connected with the first low pressure passage and a second low pressure space connected with the second low pressure valve; and an intermediate pressure unit which includes an intermediate pressure passage connected with the high temperature end of the pulse tube, an intermediate pressure valve disposed in the intermediate pressure passage and an intermediate pressure buffer tank connected with the intermediate pressure passage.

10. A pulse tube refrigerator including:

a compressor;

a regenerator fluidically connected to said compressor;

a cold head connected with a low temperature end of the regenerator;

a pulse tube having a low temperature end and a high temperature end and connected with the cold head at the low temperature end thereof;

a high pressure passage connecting an outlet of said compressor with the high temperature end of said pulse tube;

a low pressure passage connecting an inlet of said compressor with the high temperature end of said pulse tube;

high pressure line partition means in the high pressure passage for fluidically sealing the outlet of said compressor from the high temperature end of said pulse tube while permitting pressure equalization in said high pressure passage; and low pressure line partition means in the low pressure passage for fluidically sealing the inlet of said compressor from the high temperature end of said pulse tube while permitting pressure equalization in said low pressure passage.

11. A pulse tube refrigerator according to claim 10, further including means for establishing an intermediate pressure in at least one of said high pressure passage and said low pressure passage.

* * * * *